US012535005B2

(12) United States Patent
Duschl

(10) Patent No.: US 12,535,005 B2
(45) Date of Patent: Jan. 27, 2026

(54) STEAM ENGINE

(71) Applicant: RD ESTATE GMBH & CO. KG, Deggendorf (DE)

(72) Inventor: Robert Duschl, Deggendorf (DE)

(73) Assignee: RD ESTATE GMBH & CO. KG, Deggendorf (DE)

( * ) Notice: Subject to any disclaimer, the term of this patent is extended or adjusted under 35 U.S.C. 154(b) by 0 days.

(21) Appl. No.: 18/846,807

(22) PCT Filed: Mar. 10, 2023

(86) PCT No.: PCT/EP2023/056161
§ 371 (c)(1),
(2) Date: Sep. 13, 2024

(87) PCT Pub. No.: WO2023/174816
PCT Pub. Date: Sep. 21, 2023

(65) Prior Publication Data

US 2025/0223905 A1 Jul. 10, 2025

(30) Foreign Application Priority Data

Mar. 16, 2022 (EP) ..... 22162444

(51) Int. Cl.
*F01B 17/04* (2006.01)
*F01B 25/10* (2006.01)
*F01K 21/02* (2006.01)

(52) U.S. Cl.
CPC ..... *F01B 17/04* (2013.01); *F01B 25/10* (2013.01); *F01K 21/02* (2013.01); *F01B 2170/0476* (2013.01); *F01B 2250/001* (2013.01)

(58) Field of Classification Search
CPC ..... F01K 21/02; F01B 17/04; F01B 25/10; F01B 2170/0476; F01B 2250/001
See application file for complete search history.

(56) References Cited

U.S. PATENT DOCUMENTS 3,668,974 A * 6/1972 Hagdorn ..... F01B 17/04 91/242
9,316,130 B1 * 4/2016 Harmon, Sr. ..... F01L 31/00
(Continued)

FOREIGN PATENT DOCUMENTS

EP 3594459 A1 * 1/2020 ..... F01K 21/02
EP 3798413 A1 3/2021
WO 2016146459 A1 9/2016

*Primary Examiner* — Michael Leslie
(74) *Attorney, Agent, or Firm* — Seed Intellectual Property Law Group LLP

(57) ABSTRACT

The present disclosure relates to a steam engine comprising a cylinder (10), a reciprocating piston (12) which is movably guided in the cylinder (10) between an upper dead center and a lower dead center, a working chamber (18) in the cylinder (10), said working chamber being limited by the reciprocating piston (12), a steam chamber (76) for providing live steam, an intake valve (26) with a valve opening (28) which connects the steam chamber (76) and the working chamber (18), a valve seat (30) which surrounds the valve opening (28), a movable valve element (32) which interacts with the valve seat (30) in order to close and release the valve opening (28), and a valve controller (42) for moving the valve element (32), wherein the valve controller (42) has a control cylinder (44) and a control piston (46) which interacts with the valve element (32) and divides the control cylinder (44) into a pneumatic chamber (48) and a hydraulic chamber (50), wherein the hydraulic chamber (50) can be supplied with hydraulic fluid in order to lift the valve element (32) from the valve seat (30) and release the valve opening (28).

16 Claims, 2 Drawing Sheets

(56) References Cited

U.S. PATENT DOCUMENTS

| | | | | |
|---|---|---|---|---|
| 10,774,645 | B1 * | 9/2020 | Harmon, Sr. | F01L 9/16 |
| 2008/0093477 | A1 * | 4/2008 | Miczyk | F01K 21/005 239/91 |
| 2019/0055898 | A1 | 2/2019 | Roskilly et al. | |

* cited by examiner

STEAM ENGINE

TECHNICAL FIELD

The present invention relates to a steam engine, in particular to the valve controller or valve train of a steam engine.

BACKGROUND

Decentralized combined heat and power plants (CHP plants) have long been established as an advantageous alternative to the conventional combination of local heating and a central power plant. CHP plants are used to generate electric energy and useful heat; in particular, CHP plants are preferably operated on site or close to the useful heat sink. For example, internal combustion engines such as diesel or Otto engines, Stirling engines, steam engines, combustion turbines or vapor engines can be used to drive the power generator.

With regard to CHP plants, in particular the use of steam engines and reciprocating steam engines has recently attracted attention. This is primarily due to the high overall efficiency that can be achieved with low pollutant emissions and the almost free choice of liquid or solid fuel, such as wood, pellets, biogas or biomass. The high efficiency can be achieved by steam pressures of 30 bar to 800 bar, preferably 30 to 500 bar, particularly preferably 30 to 180 bar, and steam temperatures of approximately 300° C. to 600° C. Due to said advantages, reciprocating steam engines are also used in smaller plants for biomass power generation, waste heat power generation plants, waste incineration plants and thermal oxidation plants.

In order to be able to operate the reciprocating steam engine, in particular the reciprocating piston of the reciprocating steam engine, efficiently with a sufficient amount of steam that is under an accordingly high pressure, it is necessary to supply the pressurized steam/live steam to a working chamber of the reciprocating steam engine in a very short time and with precise timing in order to be able to operate the working cycle of the reciprocating piston without malfunctions (with concentricity). This requires an intake valve to be able to optimally control or regulate the fluid flow of live steam to the working chamber of the reciprocating steam engine.

Such intake valves for controlling and/or regulating a fluid flow usually comprise a valve seat and an axially movable valve element. The valve element usually has a valve stem and a valve body at one end thereof. To actuate the valve, i.e. for axial movement of the valve element, in particular the valve body, a valve train or valve controller is also provided, which is directly or indirectly connected with the valve stem in a force-transmitting manner. This allows the valve element, in particular its valve body, to be lifted from the valve seat to open the valve and allow flow through a valve opening. To bring the valve into a closed position, the valve element or valve body is brought back into contact with the valve seat, thus blocking the fluid flow through the valve opening.

Valves for controlling or regulating a fluid flow are known in the prior art, in which a closing force is applied to the valve body in the closing direction of the valve, i.e. in the direction of the valve seat, by means of a spring element in order to automatically close the valve in the unactuated state (see, for example, WO 2016/146459 A1 or EP 3 798 413).

Due to the high temperatures described above during operation of a reciprocating steam engine, thermal changes occur, in particular material expansion, which can lead to a change in the operating point of the valve. This may be due in particular to the fact that the spring characteristic curve of the spring element changes significantly over the high temperature range (cold start to operating temperature).

Furthermore, such spring elements wear out quickly under said operating conditions. As a result, the valve element, in particular the valve body, may be pressed into the valve seat with too much force during a cold start, for example. However, if the valve is repeatedly actuated, this results in high wear of the valve body and/or the valve seat, which can lead to leakage of the valve when closed.

On the other hand, at high operating temperatures and initial signs of wear, the elastic force or clamping force may decrease and the valve body may be pressed into the valve seat with too little force. Moreover, wear can result in bypass flows in the valve and malfunctions in the overall system in which the valve is used to control and/or regulate a fluid flow.

In the mentioned prior art, the valve train is formed by a tappet on the reciprocating piston, which interacts with the valve element at the upper dead center in order to lift the valve element or its valve body from the valve seat. Although satisfactory results have already been achieved in this regard, the ability to control or regulate the time period in which the valve is open and the speed at which the valve opens is limited. There is therefore a need to improve the controllability of the intake valve.

Known solenoid valves are likely to fail in the field of use of a steam engine. With valve opening times of 1 ms and less and a valve stroke of 3 mm, very large solenoids with a high power requirement of 1 KW or more would be required.

SUMMARY OF THE INVENTION

The object was therefore to provide a steam engine or a valve controller for a steam engine in which both the tightness of the intake valve can be maintained and precise timing (opening time and/or opening speed) of the intake valve can be ensured over a long operating period.

This object is solved by a steam engine comprising the features of claim 1. Advantageous further developments of the invention can be found in the dependent claims.

The basic idea of the present invention is to open the intake valve or its valve element hydraulically and close it pneumatically. This makes it possible to control or regulate the opening flank (valve stroke or valve opening and speed) of the intake valve via the hydraulic pressure. In other words, the stroke curve (gradient, compression, etc.) can essentially be adjusted as required. At the same time, a steep closing flank can be achieved by the pneumatics in the stroke curve, i.e. the intake valve closes very quickly (in particular compared to a spring). Thus, the expansion phase of the steam in the working chamber of the reciprocating piston can be extended and a higher degree of efficiency can be achieved. Furthermore, pneumatics are not subject to the above-stated disadvantages of a spring, in particular a steel spring. The tightness of the intake valve can thus be ensured over a very long period of time. In addition, pneumatics enable comparatively simple seals compared to hydraulics, since the gas pressure provides additional sealing.

According to the invention, the steam engine is a reciprocating steam engine and comprises a cylinder, a reciprocating piston which is movably guided in the cylinder between an upper dead center and a lower dead center, and a working chamber in the cylinder, said working chamber being limited by the reciprocating piston. The working chamber is not necessarily to be understood as the maximum total volume that is limited by the reciprocating piston, but rather as the space in which the supplied live steam is expanded. Furthermore, the steam engine comprises a steam chamber for providing live steam and an intake valve with a valve opening connecting the steam chamber and the working chamber, a valve seat surrounding the valve opening and a movable valve element interacting with the valve seat in order to close and release the valve opening. As explained below, the valve element can comprise a valve stem and a valve body, wherein the valve body interacts with the valve seat. Furthermore, a valve controller is provided for moving the valve element. The valve controller comprises a control cylinder and a control piston that interacts with the valve element. The control piston divides the control cylinder into a pneumatic chamber (closing chamber) and a hydraulic chamber (actuating chamber). The pneumatic chamber serves to close the valve opening, wherein the valve element or its valve body is pressed into the valve seat by the pneumatic pressure in the pneumatic chamber. The hydraulic chamber can be supplied with hydraulic fluid in order to lift the valve element from the valve seat and release the valve opening.

Although a spring may be additionally provided in the pneumatic chamber for safety, it is preferably not active during the normal closing process of the intake valve or valve element. According to a preferred embodiment, the valve controller does not need such a spring. While a spring would only apply the force partially into the control piston, the force generated by the gas pressure is distributed evenly over the entire surface of the control piston. This has the advantage that the control piston can be configured to be thinner-walled and therefore lighter.

Preferably, the valve element or its valve body is lifted from the valve seat into the steam chamber. For this purpose, the pneumatic chamber is arranged to face away from the valve seat and the hydraulic chamber is arranged to face the valve seat.

In one embodiment, the valve element has an elongated valve stem which is connected, in particular firmly connected, with the control piston.

The valve element can be guided in a linearly movable manner. In particular, the valve stem of the valve element can be guided in a linearly movable manner.

According to one embodiment, the pressure in the pneumatic chamber may be constant, wherein the pneumatic chamber may be pressurized with gas pressure from a gas pressure source that supplies gas pressure at an essentially constant pressure. The gas pressure can be between 30 bar and 100 bar, preferably between 40 bar and 70 bar. For example, air is used as a medium so that the gas pressure corresponds to an air pressure, i.e. compressed air. However, other gaseous media, such as nitrogen, can also be used.

However, in order to be able to adjust the closing flank of the stroke curve as required (gradient, compression, etc.), it can also be advantageous to vary the pressure in the pneumatic chamber. The pressure of the gas fed in (gas pressure) can therefore also be adjustable. A conventional control valve can be used for this purpose. It is also conceivable to regulate or control the gas pressure depending on the output of the steam engine. For example, the maximum steam pressure prevailing in the working chamber before expansion can be used as a parameter in this regard.

In one embodiment, the stroke (valve stroke) of the valve element can lie in a range between 1 mm and 5 mm when the valve element is lifted from the valve seat.

The valve element including the cylinder piston connected therewith can have a weight of 100 g to 300 g.

To prevent the hydraulic fluid from entering the pneumatic chamber, the control piston is sealed with respect to an inner wall (the cylinder wall) of the control cylinder. A seal is provided which seals between the inner wall (the cylinder wall) of the control cylinder and the control piston or its outer periphery. Conventional piston seals or O-rings can be used here, in particular since the pressure in the pneumatic chamber counteracts the entry of hydraulic fluid from the hydraulic chamber.

The seal can be attached to the piston. In one embodiment, however, the seal is fitted in the inner wall of the control cylinder. For example, a so-called rod seal can be used. Thus, the seal is static and the forces acting on the seal can be reduced. Consequently, the stability of the seal is increased and thus the maintenance interval of the steam engine is extended.

According to one embodiment, the control piston is configured in a cup shape. The control piston can have a control piston bottom and a cylindrical control piston wall projecting into the pneumatic chamber. A clearance between the control cylinder or the wall of the control cylinder and the control piston wall can be selected to be small, for example in the range of 0.01 mm to 0.02 mm. By means of this configuration, the control piston is guided in the control cylinder. This further reduces forces on any seals, since the seal does not have to perform a guiding function. Furthermore, by extending the possible passage path from the hydraulic chamber to the pneumatic chamber, sufficient sealing can be achieved even without a seal if the clearance is only a few μm. However, this configuration requires low manufacturing tolerances and can lead to problems during operation due to thermal expansion. Furthermore, the control piston wall can have a length or height starting from the control piston bottom that is at least twice and at most four times or at most three times as large as the diameter of the control piston or control piston bottom.

To prevent hydraulic fluid from leaking into the steam chamber and steam from leaking into the hydraulic chamber, the control cylinder is sealed with respect to the valve element, in particular the valve stem of the valve element, in opposite directions. Preferably, a rod seal that seals in opposite directions is used here.

Furthermore, the control piston on the side of the hydraulic chamber can have a diameter in a range between 20 and 30 mm, preferably 20 to 25 mm. Due to the small diameter, the opening speed of the valve element can be reduced and brought to less than 1 ms (e.g. 0.7 ms or 0.8 ms). With a diameter below 20 mm, the gas pressure required to close the valve is very high, the sensitivity of the intake valve increases and control becomes difficult. With a diameter above 30 mm, the opening time is too long.

In order to be able to regulate or control the pressure in the hydraulic chamber optimally and quickly, the hydraulic chamber can have a hydraulic opening connected with a hydraulic line for the supply and discharge of hydraulic fluid into the and from the hydraulic chamber. For rapid pressure relief in the hydraulic chamber to close the intake valve, a double-seat valve can be used, which is connected with the hydraulic line on the one hand and a supply line and a discharge line on the other, which are alternately opened and closed by a common valve element.

DESCRIPTION OF EMBODIMENTS OF THE INVENTION

Figure 1:
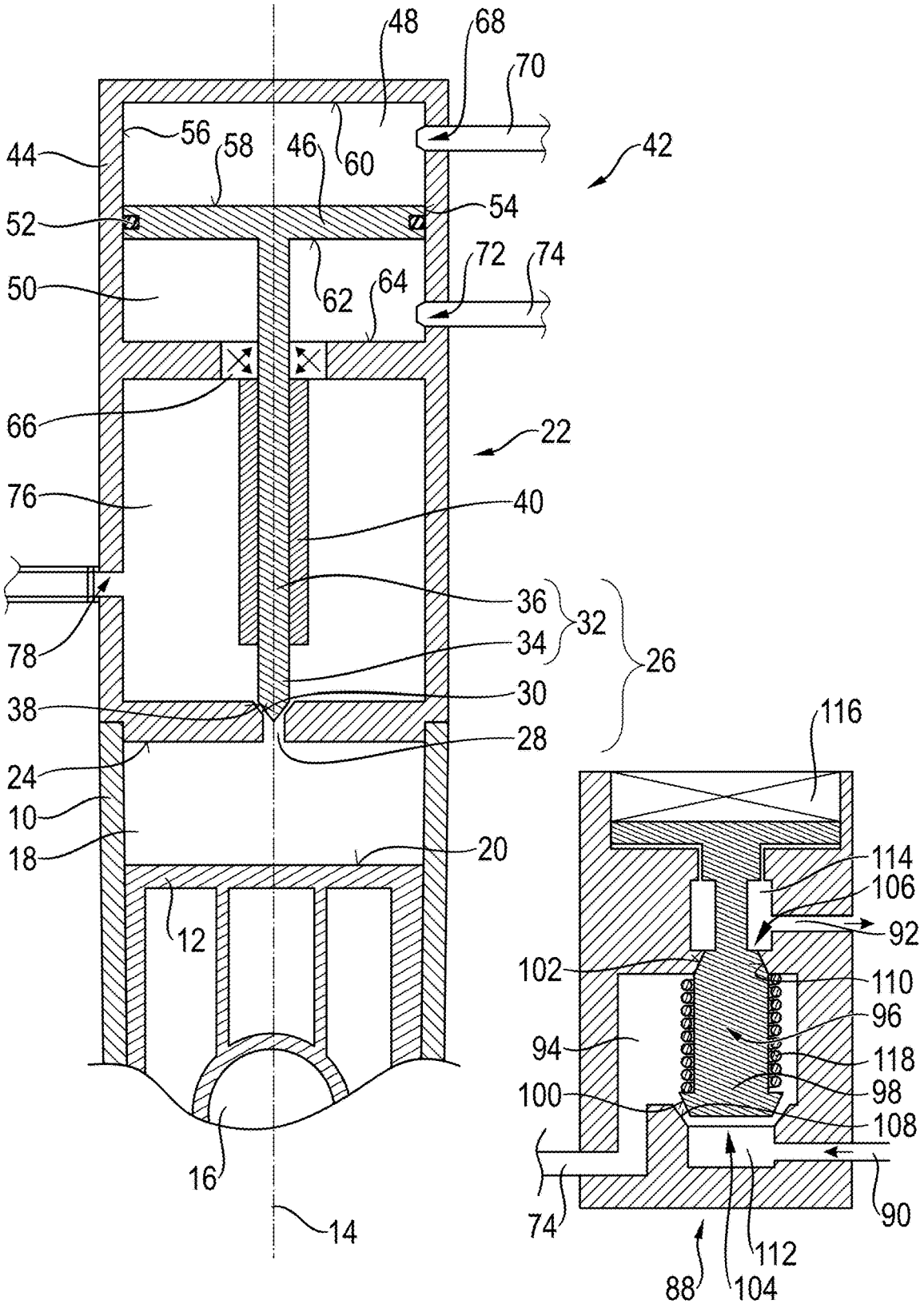
FIG. 1 shows a schematic cross-section of a cylinder assembly of a steam engine according to the present invention.

The cylinder assembly schematically illustrated in FIG. 1 comprises a cylinder 10. A reciprocating piston 12 is guided in the cylinder 10 so that it can move back and forth along the cylinder axis 14. In order to transmit the linear movement of the reciprocating piston 12, the reciprocating piston 12 has an eyelet 16 for connection with a connecting rod which is not shown and is connected to an output shaft that is not shown either.

A working chamber 18 is formed in the cylinder 10. The working chamber 18 is limited at the bottom by the upper side 20 of the reciprocating piston 12. On the opposite side, the working chamber 18 is limited by the cylinder head 22 or its lower side/bottom 24.

If the reciprocating piston 12 is at the upper dead center, the volume of the working chamber is at its minimum. This volume is also designated as compression volume or residual volume. If the reciprocating piston 12 is in the lower dead center, the volume of the working chamber 18 is at its maximum. This volume is also designated as expansion volume.

Furthermore, an intake valve 26 is shown. The intake valve comprises a valve opening 28 that is formed, in the illustrated embodiment, in the bottom 24 of the valve head 22.

Furthermore, the intake valve 26 comprises a valve seat 30 which surrounds the valve opening 28 and a valve element 32 which interacts with the valve seat 30.

The valve element 32 comprises a valve body 34 and a valve stem 36. The valve body 34 comprises a surface 38 which interacts with the valve seat 30 or comes into sealing contact therewith. In the illustrated embodiment, the surface 38 is configured in a conical shape. Similarly, the valve seat 30 is configured so as to be complementary to the surface 38.

The valve stem 36 is configured so as to be elongated and cylindrical. The base area of the conical valve body 34 is not larger in diameter than the diameter of the cylindrical valve stem 36. The valve element 32 of the intake valve 26 is thus configured in the form of a needle valve.

Furthermore, the valve element 32 is axially movable. For this purpose, the valve element 32 is guided in a guide 40. In particular, the valve stem 36 is accommodated in the guide 40 and guided in a linearly movable manner.

The cylinder head 22 further comprises a steam chamber 76, to which live steam can be supplied via a steam supply opening 78. The live steam can have a pressure of 30 bar to 800 bar, preferably 30 to 500 bar, particularly preferably 30 to 180 bar, as well as a temperature of 300° C. to 600° C.

Furthermore, a valve controller 42 is provided to move the valve element 32 axially and to lift it from the valve seat 30 or bring it into contact therewith in order to close and release the valve opening 28.

The valve controller 42 comprises a control cylinder 44 and a control piston 46. The control piston 46 is firmly connected with an end of the valve stem 36, which faces away from the valve body 34. An integral configuration, i.e. a one-piece, uniform material configuration, is conceivable for this purpose. However, it is also possible to positively and/or non-positively connect the control piston 46 with the valve stem 36 using fastening means (e.g. screws). Furthermore, a cohesive connection (e.g. by welding) is also conceivable.

The control piston 46 divides the control cylinder 44 into a pneumatic chamber 48 and a hydraulic chamber 50. The control piston 46 further comprises a piston ring 52 (O-ring) which seals an outer peripheral surface 54 of the control piston 46 with respect to an inner wall 56 of the control cylinder 44.

The pneumatic chamber 48 is limited, on the one hand, by a top surface 58 of the control piston 46 and, on the other hand, by an upper end 60 (an upper side) of the control cylinder 44.

The hydraulic chamber 50, in turn, is limited by a lower side 62 of the control piston 46 and a lower end 64 (a lower side) of the control cylinder 44.

The control piston, in particular on its lower side 62, has a diameter in a range between 20 and 30 mm, preferably 20 to 25 mm.

Furthermore, a rod seal 66 is located in the lower side 64 of the control cylinder 44, which seals in opposite directions (as illustrated by the arrows) with respect to the valve stem 36 of the valve element 32.

Moreover, a gas pressure opening 68 is provided in the control cylinder 44, at which a gas pressure line 70 is connected. Gas can be supplied to the pneumatic chamber 48 via the gas pressure line 70 and the gas pressure opening 68. A control valve, which is not shown, can be provided in the gas pressure line 70, which regulates or controls the pressure in the pneumatic chamber 48. This can be done depending on the output of the steam engine, for example the maximum pressure prevailing in the working chamber 18 before expansion.

Similarly, a hydraulic opening 72 is provided in the control cylinder 44, at which a hydraulic line 74 is connected. Hydraulic fluid, in particular hydraulic oil, can be supplied to and discharged from the hydraulic chamber 50 via the hydraulic line 74 and the hydraulic opening 72.

A double-seat valve 88 can be used in order to be able to regulate or control the pressure in the hydraulic chamber optimally and quickly. The hydraulic line 74 is connected with the double-seat valve 88. The hydraulic line 74 opens into a valve chamber 94.

A movable valve element 96 is arranged in the valve chamber 94. The valve element 96 comprises a valve body 98. The valve body 98 has a first closing surface 100 and a second closing surface 102 at opposite axial ends.

The valve chamber 94 further comprises a supply opening 104 which opens into a supply chamber 112. The supply opening 104 is surrounded by a first valve seat 108 and defined thereby. A supply line 90 opens into the supply chamber 112 and provides the required hydraulic pressure.

The valve chamber 94 further comprises a discharge opening 106 which opens into a discharge chamber 114. The discharge opening 106 is surrounded by a second valve seat 110 and defined thereby. A discharge line 92 opens into the discharge chamber 114 in order to be able to ensure rapid pressure relief.

An electromagnet 116 is provided to actively move the valve element 96. A spring 118 acts in the direction opposite to the electromagnet 116.

Figure 3:
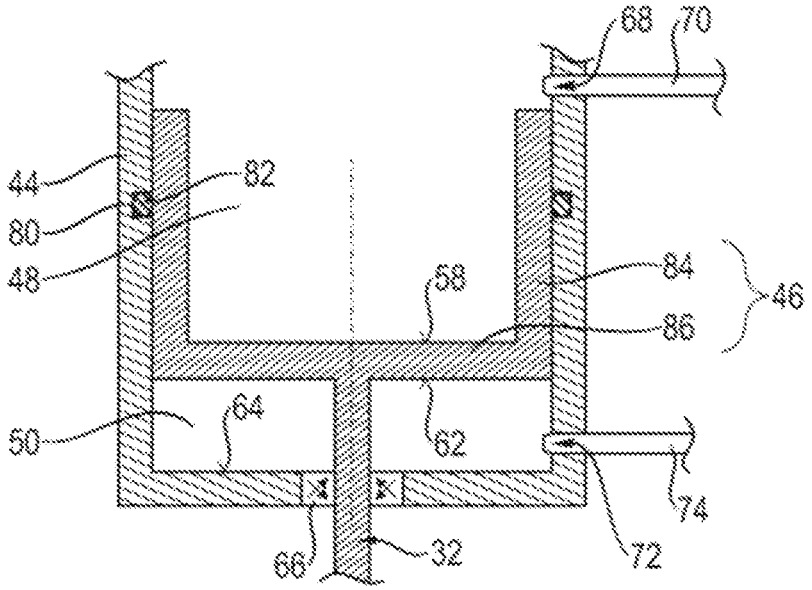
FIG. 3 shows a partial cross-section of the valve controller in a modified embodiment.

In FIG. 3, a modification of the control piston 46 and the piston ring 52 is illustrated. The rest of the configuration is identical to that described with regard to FIG. 1.

In FIG. 3, the control piston 46 is configured in a cup shape. The control piston comprises a control piston bottom 86 and a cylindrical control piston wall 84 projecting from it into the pneumatic chamber 48. A clearance between the control cylinder 44 or the wall 56 of the control cylinder 44 and the control piston wall 84 can be selected to be small, for example in the range of 0.02 mm to 0.03 mm. By means of this configuration, the control piston is guided in the control cylinder. The control piston wall 84 can have a length or height starting from the control piston bottom 86 that is at least twice and at most four times or at most three times as large as the diameter of the control piston 46 or control piston bottom 86 (it is pointed out that FIG. 3 is only schematic in this regard and not true to scale).

The control piston 46 or the control piston bottom 86 is firmly connected with an end of the valve stem 36, which faces away from the valve body 34. An integral configuration, i.e. a one-piece, uniform material configuration, is conceivable for this purpose. However, it is also possible to positively and/or non-positively connect the control piston bottom 86 with the valve stem 36 using fastening means (e.g. screws). Furthermore, a cohesive connection (e.g. by welding) is also conceivable.

The cylinder wall 56 of the control cylinder 44 has a recess 80 in which an O-ring 82 is inserted for sealing with respect to the control piston wall 84. Thus, the seal (in this case the O-ring) is static and the forces acting on the seal can be reduced. Consequently, the stability of the seal is increased. Since the seal does not have to perform a guiding function due to the cup shape, the forces on the seal are further reduced. A plurality of seals 82 can also be provided.

The functionality of the steam engine and its components is explained in more detail below.

During steam operation, live steam is continuously supplied to the steam chamber 76 via the steam supply line 78. Consequently, pressures in a range between 30 bar and 800 bar, preferably 30 to 500 bar, particularly preferably 30 to 180 bar, and temperatures in a range between 300° C. and 600° C. prevail in the steam chamber 76.

The intake valve 26 is opened to inject the live steam into the working chamber 18. The electromagnet 116 of the double-seat valve 88 is activated for this purpose. The valve element 96 is pulled or lifted against the elastic force of the spring 118. Thus, the second closing surface 102 of the valve element 96 comes into contact with the second valve seat 110 and closes the discharge opening 106. At the same time, the first closing surface 100 of the valve element 96 lifts from the first valve seat 108 and releases the supply opening 104. This allows the hydraulic fluid to flow into the valve chamber and via the hydraulic line 74 into the hydraulic chamber 50. The pressure in the hydraulic chamber 50 is thus increased by supplying hydraulic fluid via the hydraulic line 74 and the hydraulic opening 72. In order to open the intake valve 26, the pressure in the hydraulic chamber 50 must exceed the pressure in the pneumatic chamber 48, taking into account the frictional forces. The control piston 46 thus moves upwards in the control cylinder 44 against the pressure prevailing in the pneumatic chamber 48, causing the valve stem 36 to also move upwards together with the valve body 34. During this movement, the valve stem 36 is guided linearly in the guide 40. The valve body 34 or its surface 38 lifts from the valve seat 30 and the valve opening 28 is released. Consequently, live steam flows from the steam chamber 76 through the valve opening 28 into the working chamber 18. This state is shown in FIG. 1. The steam is expanded in the working chamber 18 and moves the reciprocating piston 12 in the direction of the lower dead center.

After the steam has been injected into the working chamber 18, the pressure in the hydraulic chamber 50 is reduced again by discharging hydraulic fluid from the hydraulic chamber 50 via the hydraulic opening 72 and the hydraulic line 74. The electromagnet 116 of the double-seat valve 88 is deactivated for this purpose. The valve element 96 is returned or moved downwards by the elastic force of the spring 118. Thus, the first closing surface 100 of the valve element 96 comes into contact with the first valve seat 108 and closes the supply opening 104. At the same time, the second closing surface 102 of the valve element 96 lifts from the second valve seat 110 and releases the discharge opening 106. This allows the hydraulic fluid to flow out of the hydraulic chamber 50 via the hydraulic line 74 and the valve chamber 94. The pressure prevailing in the pneumatic chamber 48 acts on the top surface 58 of the control piston 46, causing it to move downwards. Thus, the valve body 34 or its surface 38 is pressed into the valve seat 30 and the valve opening 28 is closed.

Figure 2:
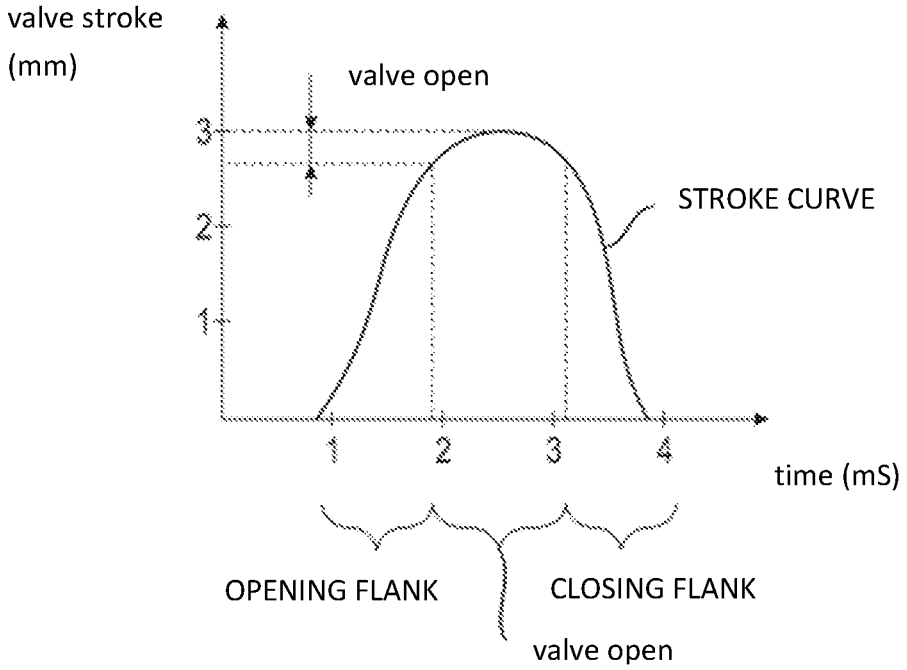
FIG. 2 shows an exemplary stroke curve of the intake valve.

The stroke curve when opening and closing the intake valve 26 is shown in FIG. 2. In the exemplary embodiment, the valve stroke is 3 mm. Opening and closing the intake valve 26 takes about 3 ms. The time to reach the "valve open" state is approximately 0.7 ms to 0.8 ms. The valve remains open for approximately 1.6 ms, wherein the maximum valve stroke is reached in this range. The time required for the valve to close completely is again approximately 0.7 ms to 0.8 ms.

The opening flank (gradient and compression) can virtually be adjusted as required via the pressure in the hydraulic chamber 50. Due to the fact that the hydraulic chamber 50 only works against the air pressure in the pneumatic chamber 48, a very fast opening (steep opening flank) can also be realized.

A constant air pressure can be applied in the pneumatic chamber 48 so that the closing flank can only be adjusted via the hydraulic chamber 50. In an exemplary embodiment, the air pressure can be 50 bar, but generally depends on the maximum pressure in the working chamber 18 (full pressure). In order to ensure reliable closing, the air pressure is always set above full pressure.

In this embodiment, the air pressure in the pneumatic chamber 48 essentially replaces the function of a conventional spring. However, the use of gas allows the intake valve 26 to open considerably faster than with a spring due to the inert mass of the spring. Also, with the required closing pressures, biasing of the spring at approximately 300 kg would be necessary, which leads to considerable effort during installation.

Alternatively, it is also conceivable to variably control the air pressure in the pneumatic chamber 48. Thus, the air pressure can be controlled by supplying gas pressure via the air pressure line 70 and the air pressure opening 68. This also allows the closing flank (gradient and compression) to be virtually adjusted as required.

The use of gas pressure in the pneumatic chamber 48 also has the considerable advantage that the gas pressure also acts to seal the control piston 46 with respect to the hydraulic chamber 50. The gas pressure counteracts the inflow of hydraulic fluid from the hydraulic chamber 50 through the gap between the outer peripheral surface 54 of the control piston 46 and the inner wall 56 of the control cylinder 44. Consequently, despite the relatively high pressures, a relatively simple seal in the form of a piston ring 52 or an O-ring is possible.

This applies in analogy to the live steam in the steam chamber 76, which also supports the sealing of the hydraulic chamber 50. However, in order to counteract degeneration of the hydraulic fluid and/or mixing of the hydraulic fluid with the live steam, a rod seal 66 is provided around the outer periphery of the valve stem 36, which seals against both the entry of live steam into the hydraulic chamber 50 and the escape of hydraulic fluid from the hydraulic chamber 50.

As described above, the combination of pneumatic and hydraulic control of the intake valve 26 offers considerable advantages in terms of assembly, operation and adjustability of the stroke curve of the intake valve.

LIST OF REFERENCE NUMBERS

10 Cylinder
12 Reciprocating piston
14 Cylinder axis
16 Eyelet
18 Working chamber
20 Upper side of the reciprocating piston
22 Cylinder head
24 Lower side of the cylinder head
26 Intake valve
28 Valve opening
30 Valve seat
32 Valve element
34 Valve body
36 Valve stem
38 Surface of the valve body
40 Guide
42 Valve controller
44 Control cylinder
46 Control piston
48 Pneumatic chamber
50 Hydraulic chamber
52 Piston ring
54 Outer peripheral surface of the control piston
56 Inner wall of the control cylinder
58 Top surface of the control piston
60 Upper end of the control cylinder
62 Lower side of the control piston
64 Lower end of the control cylinder
66 Rod seal
68 Gas pressure opening
70 Gas pressure line
72 Hydraulic opening
74 Hydraulic line
76 Steam chamber
78 Steam supply opening
80 Recess
82 O-ring
84 Control piston wall
86 Control piston bottom
88 Double-seat valve
90 Supply line
92 Discharge line
94 Valve chamber
96 Valve element
98 Valve body
100 First closing surface
102 Second closing surface
104 Supply opening
106 Discharge opening
108 First valve seat
110 Second valve seat
112 Supply chamber
114 Discharge chamber
116 Electromagnet
118 Spring

The invention claimed is:

1. A steam engine comprising:
a cylinder,
a reciprocating piston which is movably guided in the cylinder between an upper dead center and a lower dead center,
a working chamber in the cylinder, said working chamber being limited by the reciprocating piston,
a steam chamber for providing live steam,
an intake valve with a valve opening which connects the steam chamber and the working chamber, a valve seat which surrounds the valve opening, a movable valve element which interacts with the valve seat in order to close and release the valve opening, and
a valve controller for moving the valve element, the valve controller comprising:
a control cylinder; and
a control piston which interacts with the valve element and divides the control cylinder into a pneumatic chamber and a hydraulic chamber, wherein the hydraulic chamber can be supplied with hydraulic fluid in order to lift the valve element from the valve seat and release the valve opening.

2. The steam engine according to claim 1, wherein the pneumatic chamber faces away from the valve seat and the hydraulic chamber faces the valve seat in order to lift the valve element from the valve seat into the steam chamber.

3. The steam engine according to claim 1, wherein the valve element has an elongated valve stem and the control piston is connected with the valve stem.

4. The steam engine according to claim 1, wherein the valve element is guided in a linearly movable manner.

5. The steam engine according to claim 1, wherein the pneumatic chamber is pressurized with gas pressure at an essentially constant pressure.

6. The steam engine according to claim 1, wherein the pneumatic chamber is pressurized with gas pressure at a variable pressure.

7. The steam engine according to claim 1, wherein the stroke of the valve element lies in a range between 1 mm and 5 mm when the valve element is lifted from the valve seat.

8. The steam engine according to claim 1, wherein the valve element has a weight of 100 g to 300 g.

9. The steam engine according to claim 1, wherein the control piston is sealed with respect to an inner wall of the control cylinder.

10. The steam engine according to claim 9, wherein a seal is mounted in the inner wall of the control cylinder.

11. The steam engine according to claim 1, wherein the control piston is configured in a cup shape.

12. The steam engine according to claim 1, wherein the control cylinder is sealed with respect to the valve element.

13. The steam engine according to claim 1, wherein the control piston has a diameter in a range between 20 and 30 mm.

14. The steam engine according to claim 1, wherein the hydraulic chamber for the supply and discharge of hydraulic fluid into the and from the hydraulic chamber has a hydraulic opening connected with a hydraulic line which is connected with a double-seat valve, wherein the double-seat valve is connected with a supply line and a discharge line which are alternately opened and closed by a common valve element.

15. The steam engine according to claim 12, wherein the control cylinder is sealed with respect to a valve stem of the valve element.

16. The steam engine according to claim 13, wherein the control piston has a diameter in a range between 20 to 25 mm.

* * * * *